US007086550B2

(12) United States Patent
Yang et al.

(10) Patent No.: US 7,086,550 B2
(45) Date of Patent: Aug. 8, 2006

(54) TRASH CAN ASSEMBLY WITH LOCKING LID

(75) Inventors: Frank Yang, Rancho Palos Verdes, CA (US); Joseph Sandor, Santa Ana Heights, CA (US)

(73) Assignee: Simplehuman LLC, Los Angeles, CA (US)

( * ) Notice: Subject to any disclaimer, the term of this patent is extended or adjusted under 35 U.S.C. 154(b) by 17 days.

(21) Appl. No.: 10/828,067

(22) Filed: Apr. 19, 2004

(65) Prior Publication Data

US 2005/0230396 A1 Oct. 20, 2005

(51) Int. Cl.
*B65D 43/26* (2006.01)

(52) U.S. Cl. ..... 220/263; 220/908

(58) Field of Classification Search ..... 220/261–263, 220/908, 908.1, 831, 832
See application file for complete search history.

(56) References Cited

U.S. PATENT DOCUMENTS

| | | | | |
|---|---|---|---|---|
| 1,820,555 | A | | 8/1931 | Buschman |
| 1,842,603 | A | * | 1/1932 | Gray ..... 220/831 |
| 1,891,651 | A | | 12/1932 | Padelford et al. |
| 2,001,445 | A | * | 5/1935 | Abele ..... 220/263 |
| 2,563,456 | A | * | 8/1951 | Brownell ..... 220/263 |
| 2,759,625 | A | | 8/1956 | Ritter |
| 2,946,474 | A | | 7/1960 | Knapp |
| 3,008,604 | A | | 11/1961 | Garner |
| 3,654,534 | A | | 4/1972 | Fischer |
| 3,891,115 | A | | 6/1975 | Ono |
| 4,081,105 | A | | 3/1978 | Dagonnet et al. |
| 4,200,197 | A | | 4/1980 | Meyer et al. |
| 4,765,548 | A | | 8/1988 | Sing |
| 4,913,308 | A | | 4/1990 | Culbertson |
| 4,918,568 | A | | 4/1990 | Stone et al. |
| 4,972,966 | A | * | 11/1990 | Craft, Jr. ..... 220/264 |
| 5,065,272 | A | | 11/1991 | Owen et al. |
| 5,147,055 | A | | 9/1992 | Samson et al. |
| 5,170,904 | A | | 12/1992 | Neuhaus |
| 5,174,462 | A | | 12/1992 | Hames |
| 5,226,558 | A | | 7/1993 | Whitney et al. |
| 5,230,525 | A | | 7/1993 | Delmerico et al. |
| 5,249,693 | A | | 10/1993 | Gillispie et al. |
| 5,322,179 | A | | 6/1994 | Ting |
| 5,348,222 | A | | 9/1994 | Patey |
| 5,390,818 | A | | 2/1995 | LaBuda |
| 5,471,708 | A | | 12/1995 | Lynch |
| 5,474,201 | A | | 12/1995 | Liu |
| D377,554 | S | | 1/1997 | Adriaansen |
| 5,639,002 | A | * | 6/1997 | Weitbrecht et al. ..... 224/539 |
| 5,692,605 | A | * | 12/1997 | Lai ..... 206/6.1 |
| 5,769,260 | A | * | 6/1998 | Killinger et al. ..... 220/533 |
| 6,010,024 | A | | 1/2000 | Wang |
| 6,024,238 | A | | 2/2000 | Jaros |
| D435,951 | S | | 1/2001 | Yang et al. |
| 6,209,744 | B1 | | 4/2001 | Gill |
| 6,250,492 | B1 | | 6/2001 | Verbeek |
| 6,332,554 | B1 | * | 12/2001 | McCarthy ..... 220/554 |
| 6,364,147 | B1 | | 4/2002 | Meinzinger et al. |
| 6,390,321 | B1 | | 5/2002 | Wang |
| 6,626,316 | B1 | | 9/2003 | Yang |
| 6,626,317 | B1 | | 9/2003 | Pfiefer et al. |

* cited by examiner

*Primary Examiner*—Lien M. Ngo
(74) *Attorney, Agent, or Firm*—Raymond Sun

(57) ABSTRACT

A trash can assembly has a shell, a lid fitted over the top end of the shell, a foot pedal positioned adjacent the bottom end of the shell, a link assembly coupling the foot pedal and the lid, and a lock secured to the lid and removably engaged with the shell to maintain the lid in an open position without pressing the foot pedal.

12 Claims, 6 Drawing Sheets

TRASH CAN ASSEMBLY WITH LOCKING LID

BACKGROUND OF THE INVENTION

1. Field of the Invention

The present invention relates to household items, and in particular, to a trash can assembly that allows for convenient use.

2. Description of the Prior Art

A major concern for both the home and the workplace is containing and holding wastes, refuse, and trash until permanent disposal. Trash cans act as containers for holding trash and other wastes that are produced in any typical home or office. Trash and garbage cans often employ lids and covers to contain the trash and its associated odor, to hide the trash from view, and to prevent the trash from contaminating areas beyond the lid.

Conventional trash cans have been improved over the years to make them more user-friendly, sanitary, and hygienic. For example, many trash cans are now provided with a foot pedal positioned adjacent the base of the trash can so that a user can step on the foot pedal to open the lid of the trash can, thereby freeing up the user's hands to toss trash, or to change the plastic liner or bag that is used to line the trash can.

Unfortunately, to keep the lid open, the user must keep his or her foot on the pedal. If the user needs to move away from the trash can to get additional trash, or to get a new liner, the lid will slam shut. In addition, if the user is attempting to sort the contents inside the trash can, or searching for something that may have been inadvertently tossed into the trash can, it can be uncomfortable and inconvenient for the user to keep his or her feet on the pedal while maneuvering the hands inside the trash can.

Thus, there remains a need for a trash can that allows for convenient use thereof.

SUMMARY OF THE DISCLOSURE

It is an object of the present invention to provide a trash can assembly that allows the user to use the trash can more conveniently.

It is another object of the present invention to provide a trash can assembly where the lid can be temporarily locked in an opened position.

In order to accomplish the objects of the present invention, there is provided a trash can assembly that has a shell, a lid fitted over the top end of the shell, a foot pedal positioned adjacent the bottom end of the shell, a link assembly coupling the foot pedal and the lid, and a lock secured to the lid and removably engaged with the shell to maintain the lid in an open position without pressing the foot pedal.

DETAILED DESCRIPTION OF THE PREFERRED EMBODIMENTS

Figure 1:
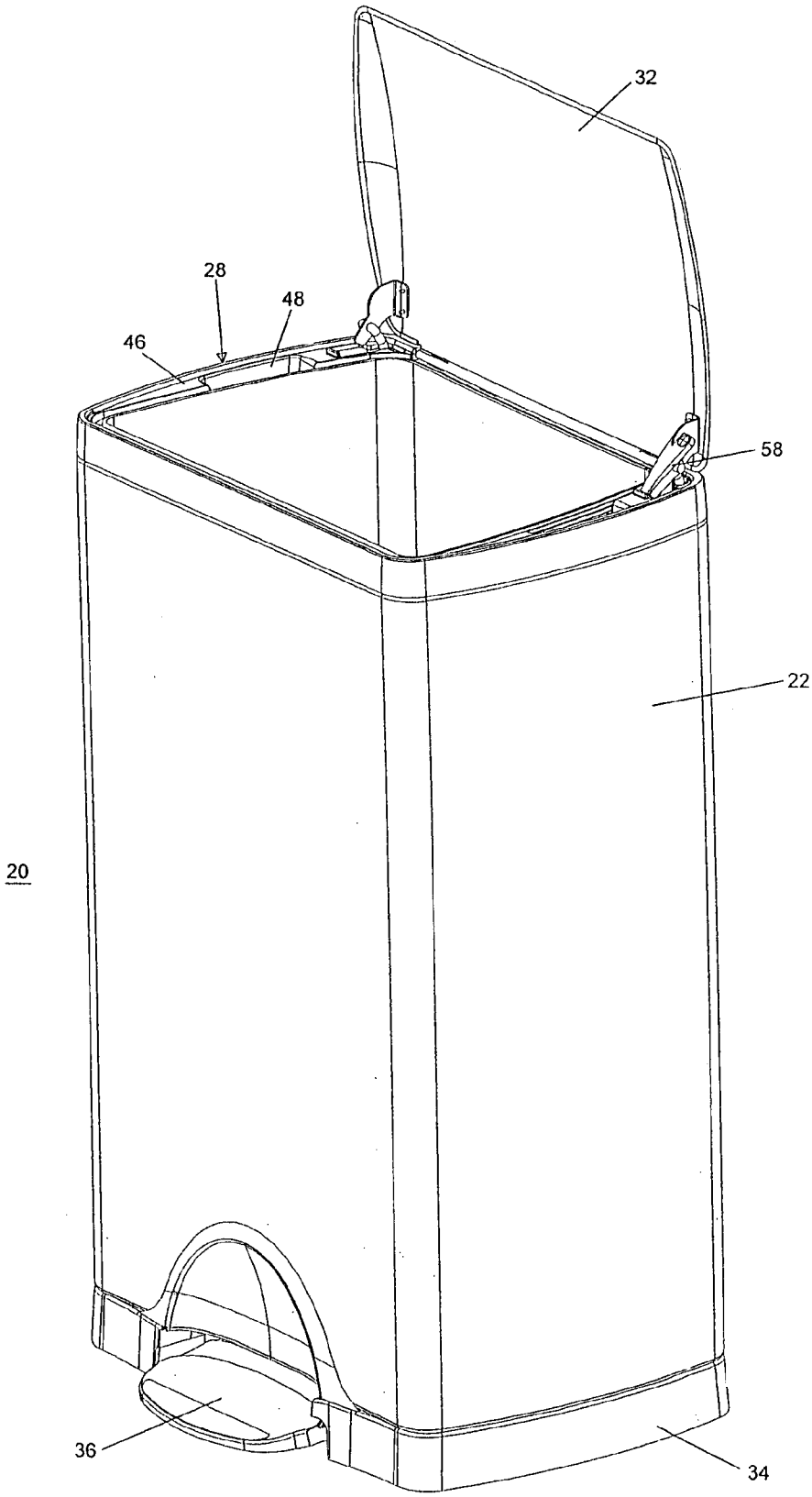
FIG. 1 is a perspective view of a trash can assembly according to one embodiment of the present invention shown with the lid opened.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

FIGS. 1–3D illustrate one embodiment of a trash can assembly 20 according to the present invention. The assembly 20 has a shell 22 and an internal liner (not shown) that is adapted to be retained inside the shell 22. The shell 22 can be made from either plastic or metal. The liner is essentially a container, and can also be made from either plastic or metal. The shell 22 is an enclosing wall which can have any desired shape, including oval, triangular, rectangular, square or circular (among others). The liner can have the same shape as the shell 22. An upper support frame 28 can be secured to the opened top of the shell 22, and can be provided in a separate material (e.g., plastic if the shell 22 is metal) from the shell 22.

A lid 32 is hingedly connected to the upper support frame 28 using hinged connections that are well-known in the art, and will not be described in greater detail herein. As one non-limiting example, the lid 32 can be hingedly connected to the shell 22 in the manner that is described in U.S. Publication No. US-2002-0079315-A1,published on Jun. 27, 2002 and entitled "Trash Can Assembly With Toe-Kick Recess", whose entire disclosure is incorporated by this reference as though set forth fully herein. The shell 22 and its lid 32 can be made of a solid and stable material, such as a metal. The shell 22 has a base 34, and a foot pedal 36 is pivotably secured to the base 34.

A link assembly extends from the foot pedal 36 along the base 34 and then upwardly along the rear shell 22 to the upper support frame 28 and the lid 32. The link assembly operates to translate an up-down pivot motion of the pedal 36 to a corresponding up-down pivot motion for the lid 32. The construction and operation of link assemblies are well-known in the art, and will not be described in greater detail herein. As one non-limiting example, the link assembly, foot pedal 36 and lid 32 can be constructed in accordance with that which is described in U.S. Publication No. US-2002-0079315-A1,published on Jun. 27, 2002 and entitled "Trash Can Assembly With Toe-Kick Recess".

Figure 2:
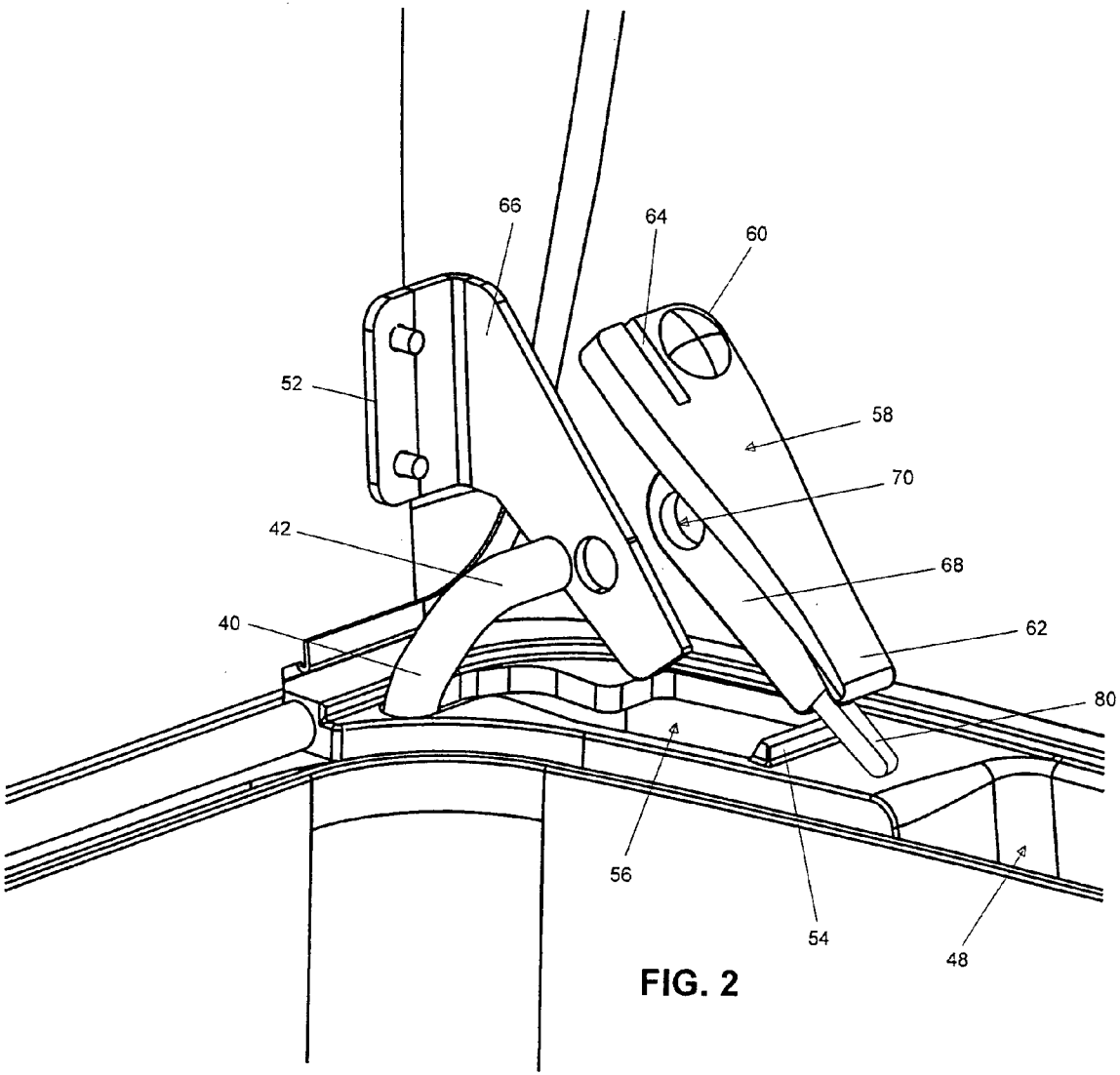
FIG. 2 is an enlarged exploded perspective view of one hinge assembly of the trash can assembly of FIG. 1.

The link assembly includes a pair of link rods 40, with each rod 40 extending from the base 34 upwardly along one edge of the rear of the shell 22 to the upper support frame 28 so that each rod 40 is aligned with a rear corner of the lid 32 (see FIG. 1). Only one link rod 40 and its accompanying hinge components are shown in FIGS. 2–3D, but both pairs of link rods 40 and their accompanying hinge components are the same. Referring to FIG. 2, each link rod 40 has a hooked end 42 that is adapted to be inserted through a hole 50 in an L-shaped bracket 52 that is fixedly secured (e.g., by screws) to the underside of the lid 32 at a corner of the lid 32. Thus, pressing and releasing the pedal 36 will cause the upper hooked end 42 of each link rod 40 to move up and down, respectively, thereby opening and closing (via the force of gravity) the lid 32, which is well-known in the art.

The support frame 28 has an elongated slot 56 provided at each rear corner of the shell 22. Each slot 56 is sized and configured to allow the bracket 52 to extend therethrough and into the interior of the shell 22. A ridge 54 is provided on the support frame 28 adjacent the front end of each slot 56.

A lock 58 has a first end 60 and an opposing second end 62. The lock 58 can be an elongated bar made of plastic. An elongated slit 64 is provided at the first end 60 and is adapted to receive the thin plate 66 of the bracket 52. A transverse section 68 extends from the bottom side of the lock 58, and has an opening 70 provided therethrough. A stop member 80 extends from the transverse section 68 at the second end 62 of the lock 58. The opening 70 is aligned with the opening 50 in the plate 66 of the bracket 52. The hooked end 42 extends through the openings 50 and 70 to pivotably secure the lock 58 and the bracket 52 together. Each slot 56 is also sized and configured to allow the lock 58 to extend therethrough and into the interior of the shell 22.

The upper support frame 28 has an annular recessed wall 46. One or more cut-outs or grooves 48 are spaced-apart about the wall 46. The grooves 48 allow the user to insert his or her fingers through the grooves 48 under the upper lip of the internal liner to lift the internal liner from the interior of the shell 24 when the lid 32 is opened. This provides a convenient way for the user to remove the internal liner from the shell 22, without requiring the user to place his or her hands inside the internal liner to grip the internal liner.

Figure 3A:
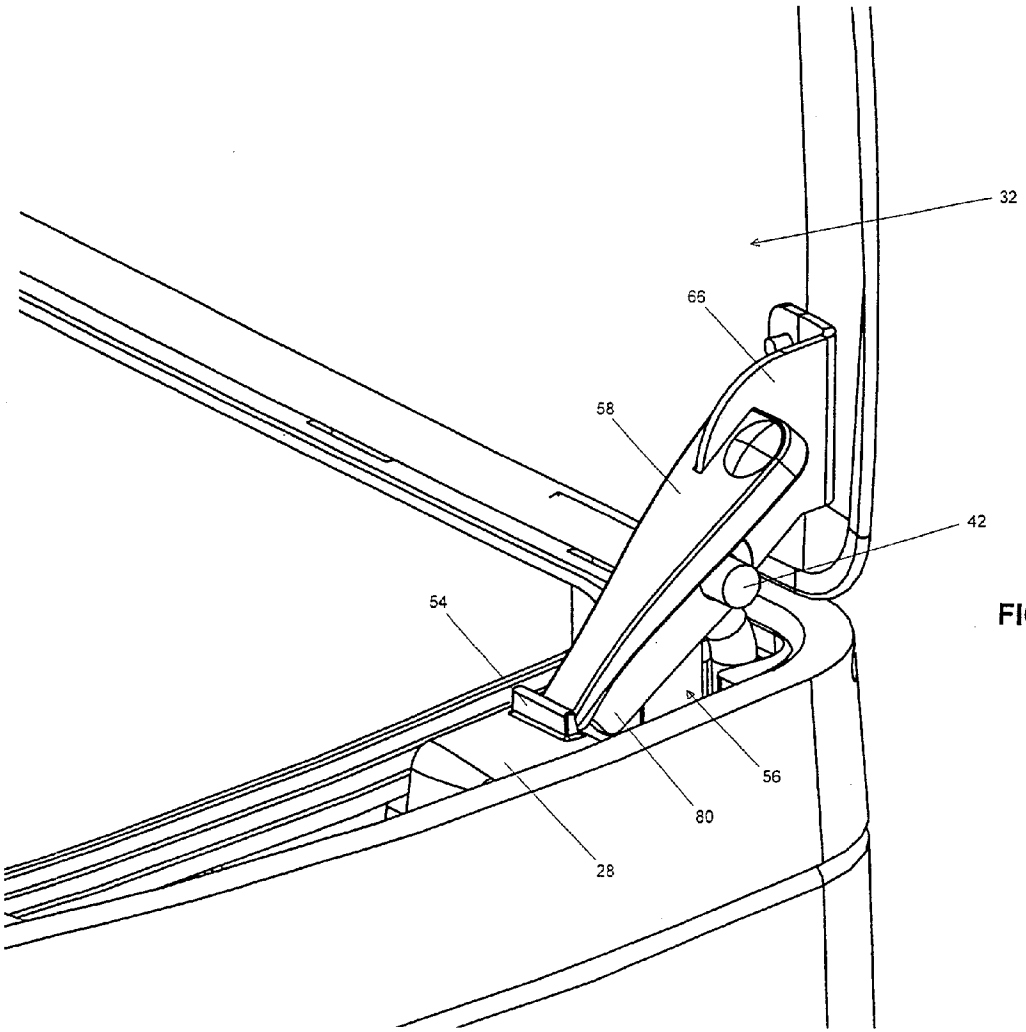
FIGS. 3A–3D are perspective views illustrating the operation of the locking mechanism of the lid for the trash can assembly of FIG. 1.
Figure 3B:
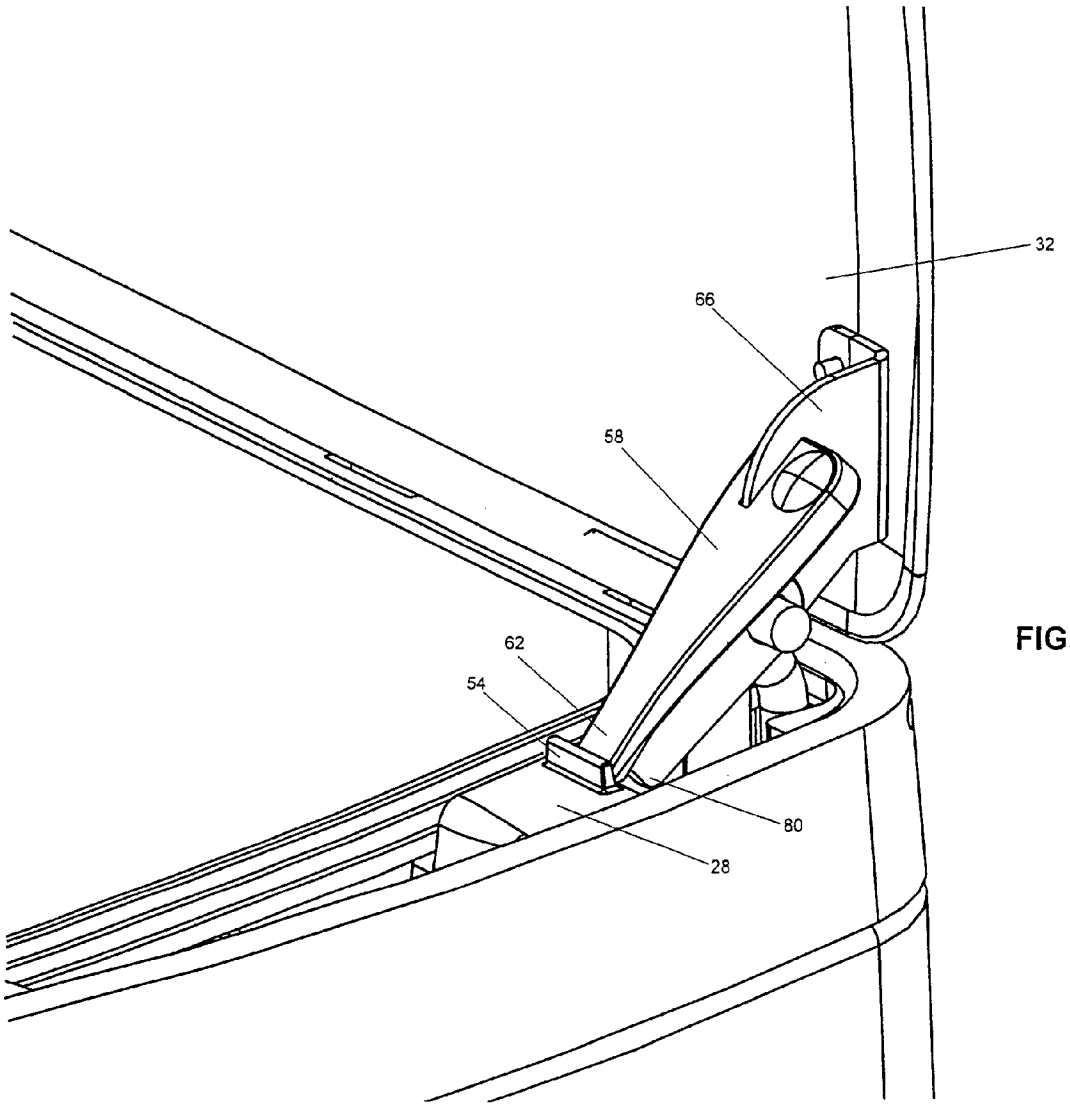
Figure 3C:
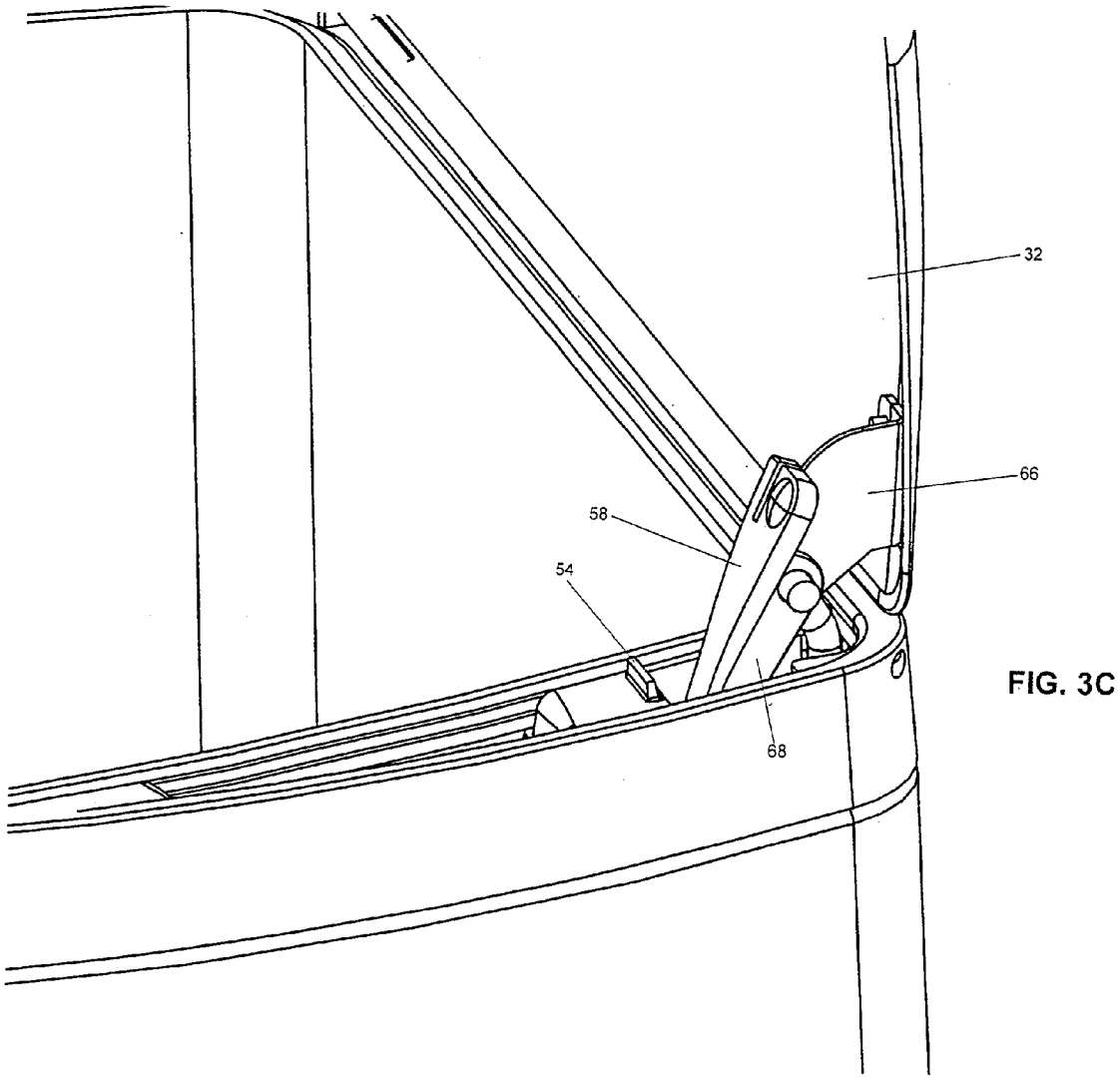
Figure 3D:
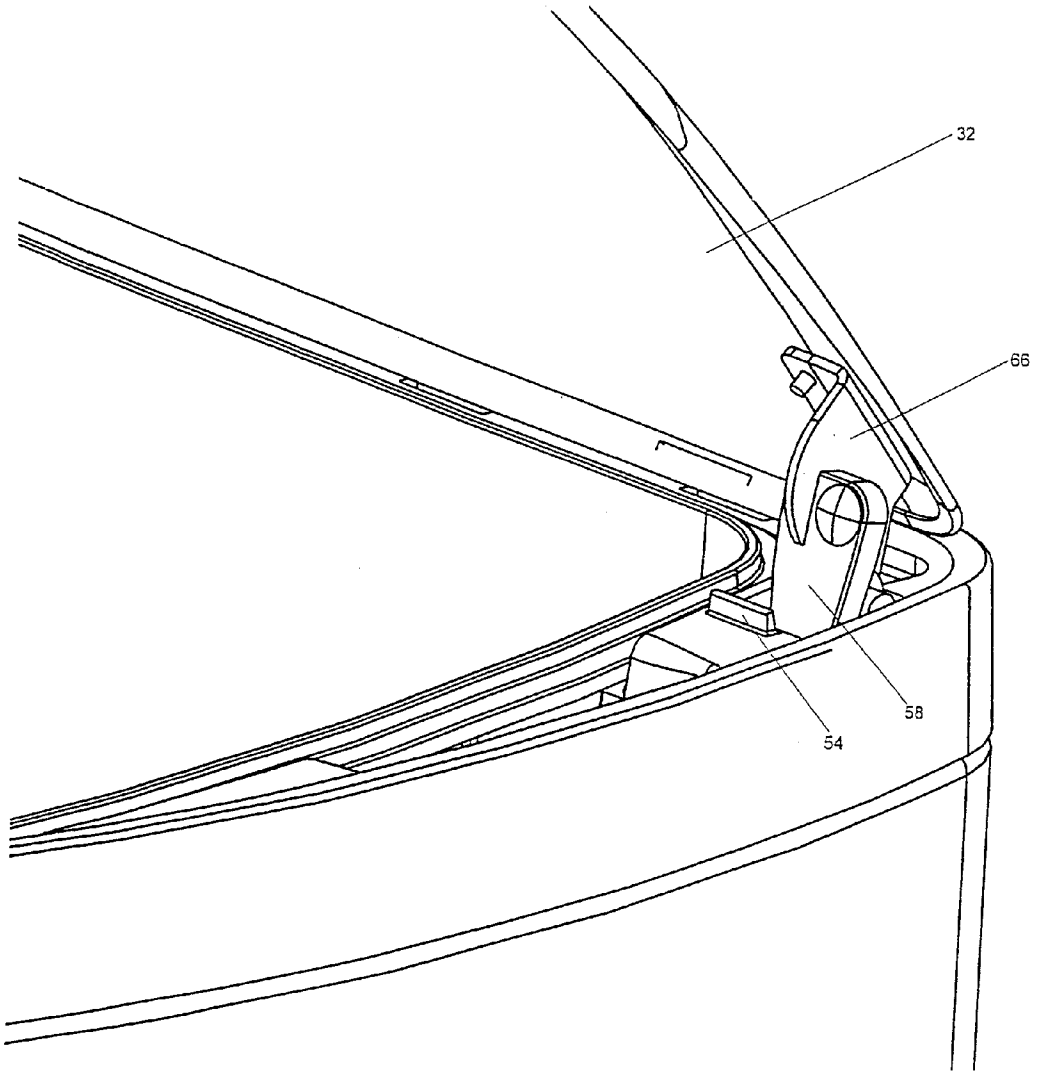

FIGS. 3A–3D illustrate how the lock 58 is used to keep the lid 32 locked in an open position. FIG. 3A illustrates the lock 58 in the locked position where the lid 32 is locked in the open position. In this position, the lock 58 is pivoted upwardly so that its second end 62 rests on the support frame 28 and abuts the ridge 54. The stop member 80 has a length that is long enough so that the stop member 80 cannot exit the slot 56 because the stop member 80 would abut the support frame 28 if the lock 58 is pivoted upwardly too much. This is best shown in FIG. 3A. Thus, the stop member 80 is always retained inside the shell 22 and the support frame 28.

The user can place the lid 32 in this open position by pressing on the pedal 36 to open the lid 32, and then using a finger to lift the lock 58 to cause the second end 62 to abut the ridge 54. With the second end 62 of the lock 58 abutting the ridge 54, the weight of the lid 32 will cause the lid 32 to pivot downwardly a little, but the continued downward (e.g., gravity and weight) force of the lid 32 will be countered by the ridge 54 and the lock 58, so that the lid 32 is maintained open. Therefore, the user does not need to maintain pressing on the pedal 36 to keep the lid 32 open.

When the user wishes to close the lid 32, the user can either disengage the second end 62 from the ridge 54, or press on the pedal 36 again. See FIG. 3B. If the user presses on the pedal 36 again, the link rod 40 will push the lid 32 upwardly again, causing the second end 62 to disengage from the ridge 54. When the second end 62 is disengaged from the ridge 54, the weight of the lock 58 will cause the second end 62 to pivot downwardly and pass through the slot 56 into the interior of the shell 22. See FIG. 3C. The weight of the lid 32 will cause the lid 32 to pivot downwardly, with the bracket 52 and the lock 58 being received inside the shell 22 via the slot 56. See FIG. 3D. When the lid 32 is closed, the bracket 52 and the lock 58 are completely received inside the shell 22.

Although FIGS. 1–3D illustrate the provision of only one lock 58, it is possible to provide a lock 58 for each hooked end 42 and bracket 52.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. A trash can assembly, comprising:

a shell having an interior, a top end and a bottom end;

a lid fitted over the top end;

a foot pedal positioned adjacent the bottom end of the shell;

a link assembly coupling the foot pedal and the lid; and a pivoting lock secured to the lid and removably engaged with the shell to maintain the lid in an open position without pressing the foot pedal;

wherein the lock is positioned inside the trash can assembly when the lid is closed, and the link assembly includes a link rod that couples the foot pedal and the lock.

2. The assembly of claim 1, further including a bracket fixedly secured to the lid, with the link rod pivotably coupling the bracket and the lock.

3. The assembly of claim 1, further including a ridge provided at the top end of the shell, with the lock removably engaged with the ridge.

4. The assembly of claim 2, further including a support frame provided at the top end of the shell, the support frame having a slot through which the bracket and the lock extend.

5. The assembly of claim 2, wherein the lock is positioned outside the interior of the shell when the lock is engaged to the ridge.

6. The assembly of claim 2, wherein the lock is positioned inside the interior of the shell when the lock is disengaged from the ridge and the lid is closed.

7. The assembly of claim 1, wherein the lock comprises a bar.

8. The assembly of claim 1, further including a stop member provided on the lock.

9. A trash can assembly, comprising:

a shell having an interior, a top end and a bottom end;

a foot pedal positioned adjacent the bottom end of the shell;

a lid fitted over the top end of the shell;

a bracket fixedly secured to the lid;

a link rod pivotably coupling the foot pedal and the bracket;

a lock coupled to the link rod;

a support frame provided at the top end of the shell, the support frame having a slot through which the bracket and the lock extend; and wherein the lock removably engages a portion of the support frame to maintain the lid in an open position without pressing the foot pedal;

wherein the lock is positioned inside the trash can assembly when the lid is closed.

10. The assembly of claim 9, further including a ridge provided on the support frame, with the lock removably engaging the ridge to maintain the lid in an open position without pressing the foot pedal.

11. The assembly of claim 10, wherein the lock is positioned outside the interior of the shell when the lock is engaged with the ridge.

12. A trash can assembly comprising:

a shell having an interior, a top end and a bottom end;

a foot pedal positioned adjacent the bottom end of the shell;

a lid fitted over the top end of the shell;

a bracket fixedly secured to the lid;

a link rod pivotably coupling the foot pedal and the bracket;

a lock coupled to the link rod;

a support frame provided at the top end of the shell the support frame having a slot through which the bracket and the lock extend;

a ridge provided on the support frame with the lock removably engaging the ridge to maintain the lid in an open position without pressing the foot pedal;

wherein the lock removably engages a portion of the support frame to maintain the lid in an open position without pressing the foot pedal; and wherein the lock is positioned inside the interior of the shell when the lock is disengaged from the ridge and the lid is closed.

* * * * *